US011802669B1

(12) United States Patent
Wang et al.

(10) Patent No.: US 11,802,669 B1
(45) Date of Patent: Oct. 31, 2023

(54) LED STRAIGHT TUBE LAMP WITH AN END FACE SWITCH FOR A TONE ADJUSTMENT AND A POWER ADJUSTMENT

(71) Applicant: Hengdian Group Tospo Lighting Co., Ltd., Zhejiang (CN)

(72) Inventors: Ye Wang, Zhejiang (CN); Kaixuan Ge, Zhejiang (CN); Chaoyang Zhou, Zhejiang (CN); Cuiyun Yang, Zhejiang (CN); Zhiying Huang, Zhejiang (CN)

(73) Assignee: HENGDIAN GROUP TOSPO LIGHTING CO., LTD., Zhejiang Province (CN)

( * ) Notice: Subject to any disclaimer, the term of this patent is extended or adjusted under 35 U.S.C. 154(b) by 0 days.

(21) Appl. No.: 17/979,954

(22) Filed: Nov. 3, 2022

(30) Foreign Application Priority Data

Jul. 12, 2022 (CN) ..... 202221793049.3

(51) Int. Cl.

| | |
|---|---|
| ***F21S 4/28*** | (2016.01) |
| ***F21V 23/06*** | (2006.01) |
| ***F21V 23/04*** | (2006.01) |
| *F21Y 115/10* | (2016.01) |

(52) U.S. Cl.
CPC ..... *F21S 4/28* (2016.01); *F21V 23/04* (2013.01); *F21V 23/06* (2013.01); *F21Y 2115/10* (2016.08)

(58) Field of Classification Search
CPC . F21V 4/28; F21V 23/04; F21V 23/06; F21Y 2115/10
See application file for complete search history.

(56) References Cited

FOREIGN PATENT DOCUMENTS

| | | | | |
|---|---|---|---|---|
| CN | 211232456 U | * | 8/2020 | ..... F21K 9/278 |
| CN | 218103575 U | * | 12/2022 | |
| EP | 3667156 A1 | * | 6/2020 | ..... F21K 9/232 |

* cited by examiner

*Primary Examiner* — Anabel Ton
(74) *Attorney, Agent, or Firm* — MUNCY, GEISSLER, OLDS & LOWE, P.C.

(57) ABSTRACT

The present invention discloses an LED straight tube lamp with an end face switch for a tone adjustment and a power adjustment, which belongs to the technical field of LED lamps, comprising a lamp tube, wherein an inside of the lamp tube is provided with a light source board, one end of the lamp tube is provided with a first plug, another end of the lamp tube is provided with a second plug, the first plug is provided with a first driving board, the second plug is provided with a second driving board, both the first driving board and the second driving board are connected to the light source board, a switch is provided on the second driver board, an end face of the second plug is provided with an oblique groove, and an interior of the oblique groove is provided with a notch for extending a handle of the switch. In the present invention, the handle of the switch is arranged at the end face of the second plug, and an end of the handle of the switch is flush with the end face of the second plug. There is no need to increase the length of the second plug. The length of the whole lamp is not affected. The increase of material cost is avoided. The oblique groove arranged on the end face of the second plug of the present invention makes it easy to toggle the handle of the switch.

7 Claims, 4 Drawing Sheets

LED STRAIGHT TUBE LAMP WITH AN END FACE SWITCH FOR A TONE ADJUSTMENT AND A POWER ADJUSTMENT

TECHNICAL FIELD

The present invention belongs to the technical field of LED lamps, in particular to an LED straight tube lamp with an end face switch for a tone adjustment and a power adjustment.

TECHNICAL BACKGROUND

With the rapid development of the lighting industry, single-function products often cannot keep up with the pace of the development of the lighting era, so some creative products are needed to replace them, such as products that adjust the tone and power to attract consumers. In this way, one lamp can be used more than one way to save the cost of turnover and warehouse storage.

The products on the market generally use a plug arc surface to design a slide cover to drive the switch design, but there are the following problems:

1. The plug arc surface is designed with a sliding cover to drive the switch, which will inevitably lead to the problem that the plug is too long due to the movement length of the switch, thus resulting in an increase in material cost. The groove in the sliding cover is attached to the switch handle, so it is also not conducive to manual assembly, resulting in low efficiency.

2. The plug arc surface is designed with a sliding cover. After the whole lamp is installed in a bracket, there is an electrocution risk during an operation, thus there is a great safety hazard.

SUMMARY OF THE INVENTION

In order to solve the problems raised in the above technical background, the present invention provides an LED straight tube lamp with an end face switch for a tone adjustment and a power adjustment, which has the characteristics of high safety and reduces the electrocution risk during operation.

To achieve the above object, the present invention provides the following technical solutions: An LED straight tube lamp with an end face switch for a tone adjustment and a power adjustment, comprising a lamp tube, wherein an inside of the lamp tube is provided with a light source board, one end of the lamp tube is provided with a first plug, another end of the lamp tube is provided with a second plug, both the first plug and the second plug are provided with pins, the first plug is provided with a first driving board embedded in the lamp tube, the second plug is provided with a second driving board embedded in the lamp tube, both the first driving board and the second driving board are connected to the light source board, a switch is provided on the second driver board, an end face of the second plug is provided with an oblique groove, and an interior of the oblique groove is provided with a notch for extending a handle of the switch.

In order not to affect the length of the whole lamp and avoid the increase of material cost, further, an end of the handle of the switch is flush with the end face of the second plug.

In order to facilitate the quick turning of the handle of the switch to the required position, further, a positioning mark is provided on the oblique groove.

In order to facilitate the installation of the second driving board, further, an inside of the second plug is provided with a card slot, and both sides of the second driving board are embedded inside the card slot.

In order to cover the metal parts of the switch, so that the metal parts of the switch cannot be observed from the pins surface, and to improve the safety of use and meet the requirement of UL safety certification, further, the lamp comprises a switch plate, and the switch plate is located between the switch and the oblique groove.

In order to facilitate the passage of the handle of the switch, further, an inside of the switch plate is provided with a through groove.

In order to mark parameters such as a model and a specification of the whole lamp, and at the same time, the first driving board inside the lamp can be blocked from view, so as to increase the aesthetics, further, the lamp comprises a label sleeve, the label sleeve is sleeved on an outside of the lamp tube at a position corresponding to the first driving board.

In order to realize the adjustment of different color temperatures, further, the second driver board is provided with a dimming circuit, the light source board is provided with two different color temperature LED lamp beads, one is LED1-LEDn, another is LED1'-LEDn', and wherein the dimming circuit comprises a driving power supply U1, a positive terminal of the driving power supply U1 is connected to positive terminals of the LED1-LEDn and the LED1'-LEDn' respectively; a negative terminal of LED1-LEDn is respectively connected to a positive terminal of a diode D1, one end of a resistor R1, a resistor R2, a resistor R3 and a resistor R4, another end of the resistor R1 and the resistor R2 are connected to a positive terminal of a diode D2, another end of the resistor R3 and the resistor R4 are connected to a positive terminal of a diode D3, a negative terminal of the LED1'-LEDn' is respectively connected to a positive terminal of a diode D5, one end of a resistor R5, a resistor R6, a resistor R7 and a resistor R8; another end of the resistor R5 and the resistor R6 are connected to a positive terminal of a diode D4, another end of the resistor R7 and the resistor R8 are connected to a positive terminal of a diode D6, negative terminals of the diode D2 and the diode D5 are connected to a pin 1 of a switch SW, negative terminals of the diode D3 and the diode D4 are connected to a pin 2 of the switch SW, negative terminals of the diode D1 and the diode D6 are connected to a pin 3 of the switch SW, and a pin 4 of the switch SW is connected to a negative terminal of the driving power supply U1.

Compared with the existing technology, the beneficial effects of the present invention are:

1. In the present invention, the handle of the switch is arranged at the end face of the second plug, and the end of the handle of the switch is flush with the end face of the second plug. There is no need to increase the length of the second plug. It does not affect the length of the whole lamp, and avoids the increase of material costs;
2. The oblique groove provided on the end face of the second plug of the present invention may make it easy to toggle the handle of the switch;
3. The present invention may adjust the color temperature through the switch as required before installation, and the switch cannot be adjusted after the whole lamp is installed, which reduces the electrocution risk during operation and improves the safety of use;
4. There is a positioning mark on the oblique groove of the present invention, which is convenient to quickly move the handle of the switch to the required position;

5. The present invention also includes a switch plate, the switch plate is located between the switch and the oblique groove, and the metal part of the switch is covered by the switch plate, so that the metal part of the switch cannot be observed from the pins surface, improving the safety of use and meeting the requirement of UL safety certification;
6. The present invention may realize the functions of 2700K, 3500K, 4000K, 4500K, 5000K and 6500K etc. of various conventional color temperatures. Moreover, the luminous flux power and luminous efficiency between different color temperatures are similar, which is more conducive to controlling the deviation. Further, at high and low color temperatures, two sets of LEDs are lit at the same time. The current of a single LED is lower. The whole light efficiency is higher. The LED temperature is evenly distributed. The LED life is greatly improved. The light efficiency at high and low color temperatures is greatly improved. The performance is reliable and the production cost is low. It also avoids the waste in the existing technology when a single set LEDs is on and the other set of LED is off when the color temperature is adjusted high and low, thus is more energy-saving and environmentally friendly.

DESCRIPTION OF FIGURES

The accompanying figures are used to provide a further understanding of the present invention, and they constitute a part of the specification. They are used to explain the present invention together with the embodiments of the present invention, and do not constitute a limitation to the present invention. In the attached figures.

In the figure: 1. Lamp tube; 2. First driving board; 3. Label sleeve; 4. First plug; 5. Light source board; 6. Pins; 7. Second plug; 71. Oblique groove; 72. Notch; 73. Positioning mark; 74. Card slot; 8. Second driving board; 81. Switch; 9. Switch plate; 91. Through groove.

DESCRIPTION

The technical solutions in the embodiments of the present invention will be clearly and completely described below with reference to the accompanying figures in the embodiments of the present invention. Obviously, the described embodiments are only a part of the embodiments of the present invention, rather than all the embodiments. Based on the embodiments of the present invention, all other embodiments obtained by those of ordinary skill in the art without inventive step fall within the protection scope of the present invention.

EMBODIMENT 1

Figure 1:
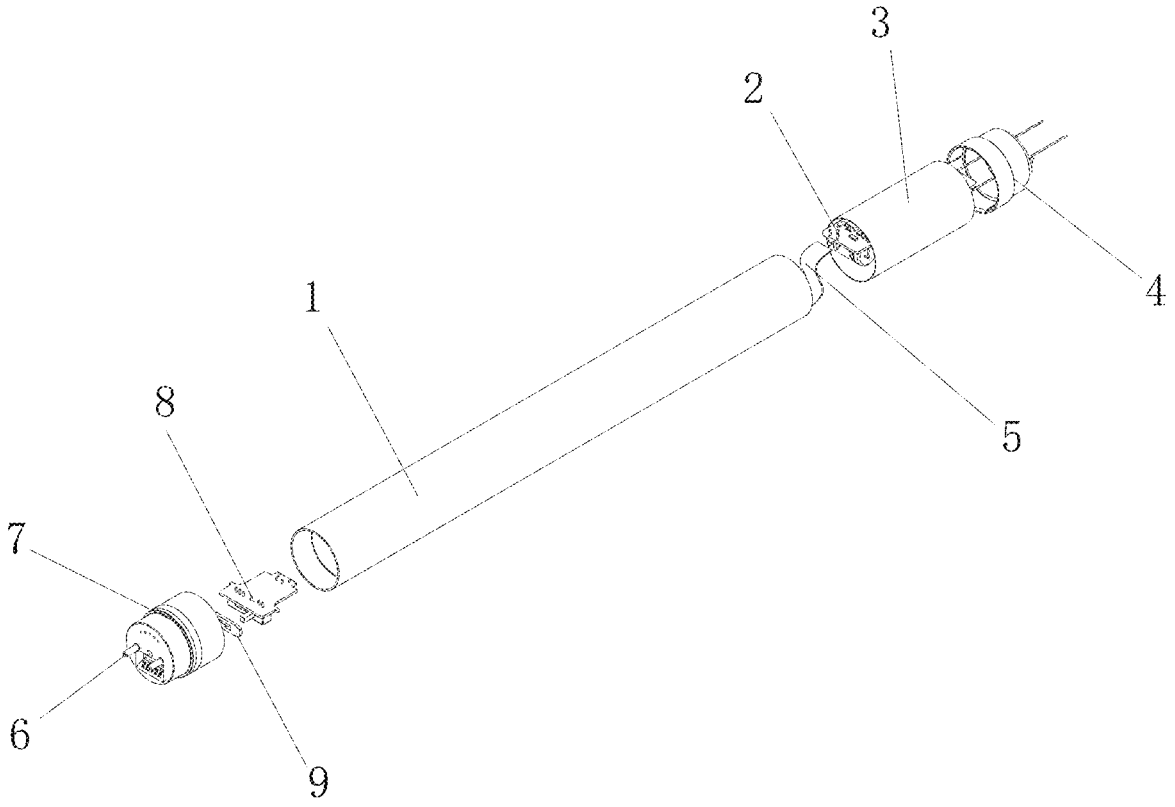
FIG. 1 is an exploded structural illustrative diagram of the present invention.
Figure 2:
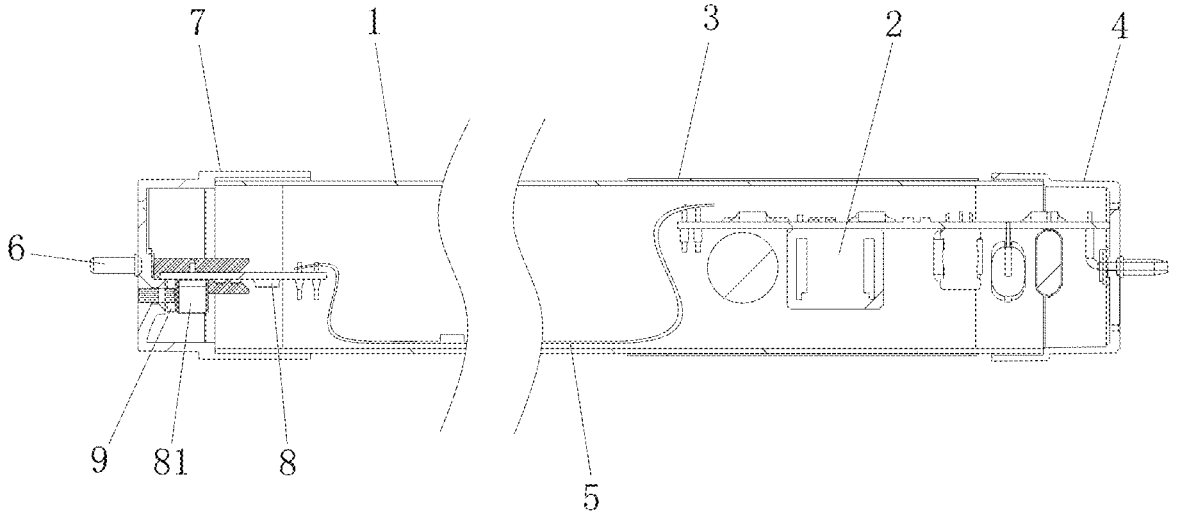
FIG. 2 is a sectional structural illustrative diagram of the present invention.
Figure 3:
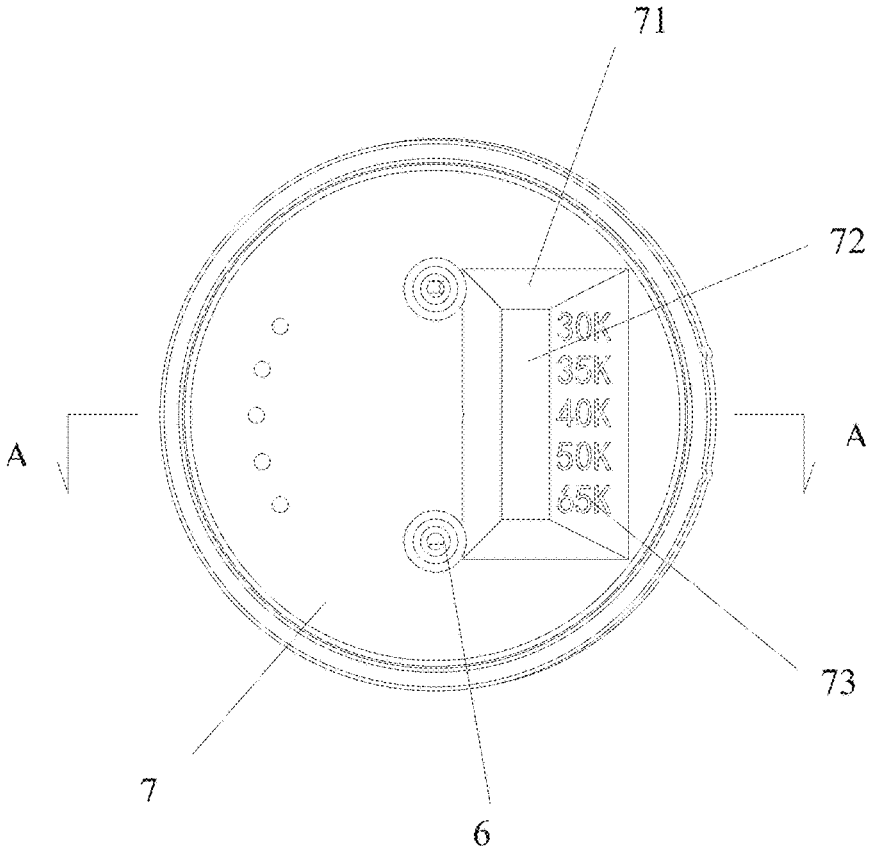
FIG. 3 is a structural representation of the second plug of the present invention.
Figure 4:
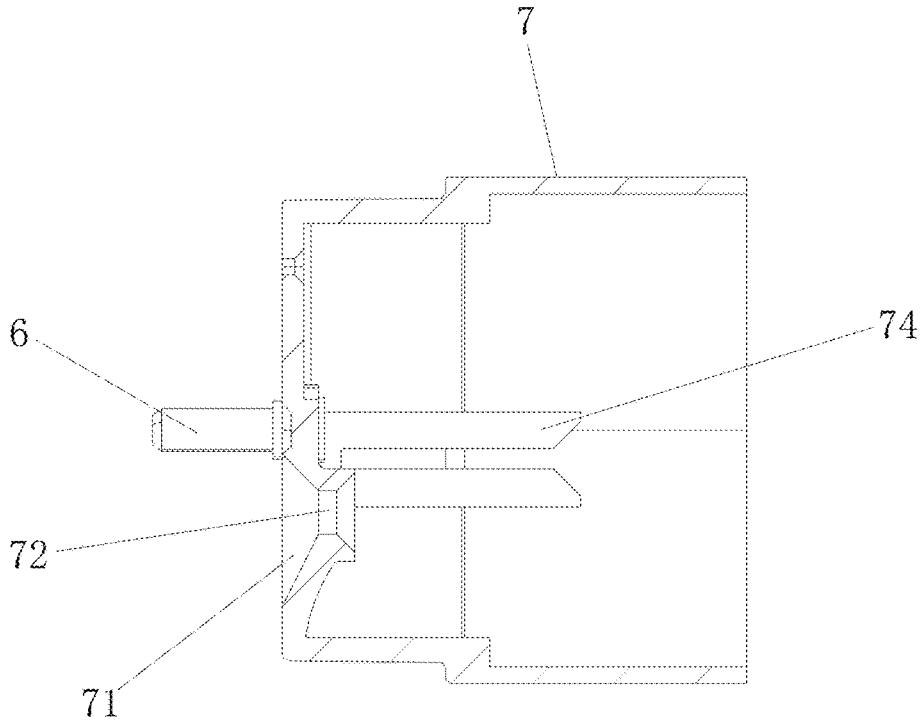
FIG. 4 is a sectional structural illustrative diagram of the A-A direction in FIG. 3 of the present invention.
Figure 5:
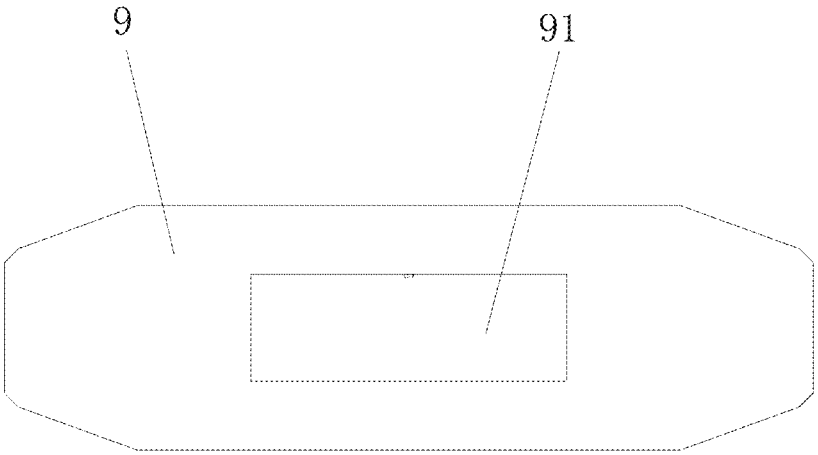
FIG. 5 is a structural illustrative diagram of a switch plate of the present invention.
Figure 6:
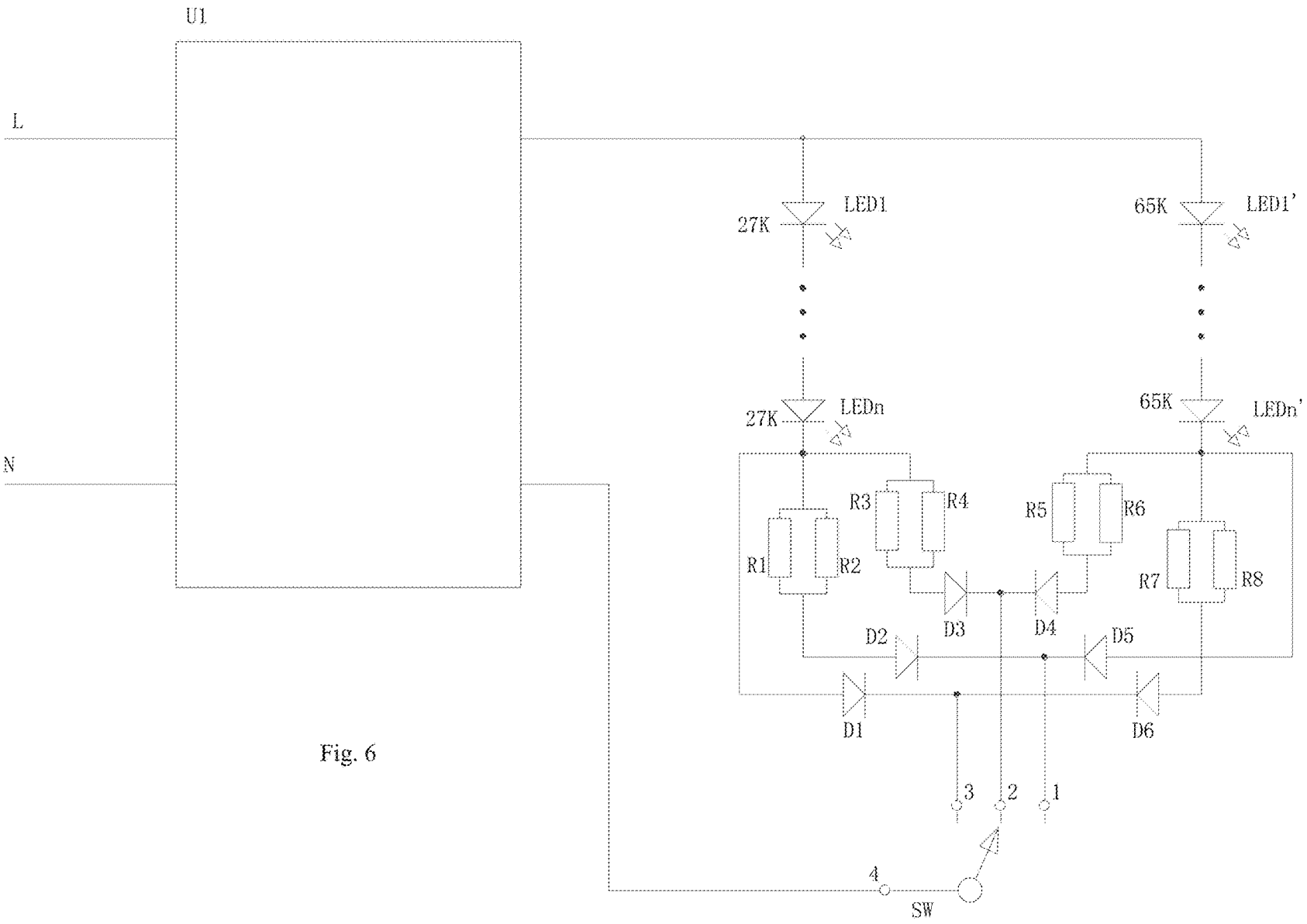
FIG. 6 is a circuit diagram of a dimming circuit of the present invention connected to two sets of LED lamp beads with different color temperatures.

Referring to FIGS. 1 to 6, the present invention provides the following technical solutions: an LED straight tube lamp with an end face switch for a tone adjustment and a power adjustment, comprising a lamp tube 1, wherein an inside of the lamp tube 1 is provided with a light source board 5, one end of the lamp tube 1 is provided with a first plug 4, another end of the lamp tube 1 is provided with a second plug 7, both the first plug 4 and the second plug 7 are provided with pins 6, the first plug 4 is provided with a first driving board 2 embedded in the lamp tube 1, the second plug 7 is provided with a second driving board 8 embedded in the lamp tube 1, both the first driving board 2 and the second driving board 8 are connected to the light source board 5, a switch 81 is provided on the second driver board 8, an end face of the second plug 7 is provided with an oblique groove 71, and an interior of the oblique groove 71 is provided with a notch 72 for extending a handle of the switch 81.

Specifically, the end of the handle of the switch 81 is flush with the end face of the second plug 7.

By adopting the above technical solution, the handle of the switch 81 is arranged at the end face of the second plug 7, and the end of the handle of the switch 81 is flush with the end face of the second plug 7, without increasing the length of the second plug 7, thus the length of the whole lamp is not affected, and the increase in material cost is avoided. The oblique groove 71 provided on the end face of the second plug 7 can facilitate the toggle of the handle. The switch 81 is adjusted as required before installation, and the switch 81 cannot be adjusted after the whole lamp is installed, which reduces the electrocution risk during operation and improves the safety of use.

Specifically, the oblique groove 71 is provided with a positioning mark 73.

By adopting the above technical solution, it is convenient to quickly turn the handle of the switch 81 to the required position.

Specifically, the inside of the second plug 7 is provided with a card slot 74, and both sides of the second driving board 8 are embedded in the card slot 74.

By adopting the above technical solution, the installation of the second driving board 8 is facilitated.

EMBODIMENT 2

The difference between this embodiment and Embodiment 1 is that: specifically, a switch plate 9 is also included, and the switch plate 9 is located between the switch 81 and the oblique groove 71.

By adopting the above technical solution, the metal parts of the switch 81 are covered by the switch plate 9, so that the metal parts of the switch 81 cannot be observed from the pins surface, which improves the safety of use and meets the requirement of UL safety certification.

Specifically, the inside of the switch plate 9 is provided with a through groove 91.

By adopting the above technical solution, the passage of the handle of the switch 81 is facilitated.

EMBODIMENT 3

The difference between this embodiment and Embodiment 1 is that, specifically, a label sleeve 3 is further included, and the label sleeve 3 is sleeved at a position corresponding to the first driving board 2 outside the lamp tube 1.

By adopting the above technical solution, the parameters such as model and specification of the whole lamp can be marked, and at the same time, the first driving board 2 inside the lamp tube 1 can be blocked from view, thereby increasing the aesthetics.

EMBODIMENT 4

The difference between this embodiment and Embodiment 1 is that: specifically, the second driver board is provided with a dimming circuit, the light source board is provided with two different color temperature LED lamp beads, one is LED1-LEDn, another is LED1'-LEDn', and wherein the dimming circuit comprises a driving power supply U1, a positive terminal of the driving power supply U1 is connected to positive terminals of the LED1-LEDn and the LED1'-LEDn' respectively; a negative terminal of LED1-LEDn is respectively connected to a positive terminal of a diode D1, one end of a resistor R1, a resistor R2, a resistor R3 and a resistor R4, another end of the resistor R1 and the resistor R2 are connected to a positive terminal of a diode D2, another end of the resistor R3 and the resistor R4 are connected to a positive terminal of a diode D3, a negative terminal of the LED1'-LEDn' is respectively connected to a positive terminal of a diode D5, one end of a resistor R5, a resistor R6, a resistor R7 and a resistor R8; another end of the resistor R5 and the resistor R6 are connected to a positive terminal of a diode D4, another end of the resistor R7 and the resistor R8 are connected to a positive terminal of a diode D6, negative terminals of the diode D2 and the diode D5 are connected to a pin 1 of a switch SW, negative terminals of the diode D3 and the diode D4 are connected to a pin 2 of the switch SW, negative terminals of the diode D1 and the diode D6 are connected to a pin 3 of the switch SW, and a pin 4 of the switch SW is connected to a negative terminal of the driving power supply U1.

By using the above technical solution, the unidirectional conduction characteristic of the diode is used to control the conduction direction of the current, and the current blocking or conduction of the two sets of LED lamp beads with different color temperatures is accurately controlled. Resistors with different resistance values are connected in series with two parallel sets of LED lamp beads of different color temperature, so that the voltage and current difference of the two parallel LED lamp beads of different color temperature occurs. Cleverly utilizing the characteristics of different brightness of two sets of LED lamp beads with different color temperature in parallel under different current conditions, and controlling the voltage difference of two sets of LED lamp beads with different color temperature through diodes and resistors to fix the current characteristics, such that the brightness of the two sets of LED lamp beads with different color temperature is different to realize the color temperature adjustment. For different positions, the total value of the current flowing through the two sets of LED lamp beads with different color temperature remains unchanged, and the voltage fluctuation of the two sets of LED lamp beads with different color temperature is also small, so the total power and luminous flux will not deviate, and the power luminous flux under different color temperatures is stable.

Specifically, LED1-LEDn are several 2700K LED lamp beads connected in series, and LED1'-LEDn' are several 6500K LED lamp beads connected in series. The method for realizing color temperature adjustment of the present invention comprises the following steps:

(1) When the switch SW is toggled to the pin 1 position, LED1-LEDn and LED1'-LEDn' light up at the same time. Under the action of diodes and resistors, the current flowing through LED1'-LEDn' is greater than the current flowing through LED1-LEDn, so as to achieve a certain color temperature in the range of 4500K to 6500K.

(2) When the switch SW is toggled to the pin 2 position, LED1-LEDn and LED1'-LEDn' light up at the same time. Under the action of diodes and resistors, the current flowing through LED1'-LEDn' and the current flowing through LED1-LEDn can be controlled respectively by controlling the size of the two resistors, so that the color temperature can be adjusted to a certain color temperature in the range of 3000K to 6000K.

(3) When the switch SW is toggled to the pin 3 position, LED1-LEDn and LED1'-LEDn' light up at the same time. Under the action of diodes and resistors, the current flowing through LED1'-LEDn' is less than the current flowing through LED1-LEDn, so as to adjust the color temperature to a certain color temperature in the range of 2700 to 4500K.

By adopting the above technical solutions, a variety of conventional color temperature functions such as 2700K, 3500K, 4000K, 4500K, 5000K and 6500K can be realized, and the luminous flux power and luminous efficacy between different color temperatures are similar, which is more conducive to controlling deviation. Moreover, at high and low color temperatures, two sets of LEDs are lit at the same time. The current through a single LED is lower. The whole light efficiency is higher. The LED temperature is evenly distributed. The LED life is greatly improved. The light efficiency at high and low color temperatures is greatly improved, with reliable performance and low production cost.

To sum up, in the present invention, the handle of the switch 81 is arranged at the end face of the second plug 7, and the end of the handle of the switch 81 is flush with the end face of the second plug 7. There is no need to increase the length of the second plug 7. It does not affect the length of the whole lamp, and avoids the increase of material costs. The oblique groove 71 provided on the end face of the second plug 7 of the present invention may make it easy to toggle the handle of the switch. The present invention may adjust the color temperature through the switch 81 as required before installation, and the switch 81 cannot be adjusted after the whole lamp is installed, which reduces the electrocution risk during operation and improves the safety of use. There is a positioning mark 73 on the oblique groove 71 of the present invention, which is convenient to quickly move the handle of the switch 81 to the required position. The present invention also includes a switch plate 9, the switch plate 9 is located between the switch 81 and the oblique groove 71, and the metal part of the switch 81 is covered by the switch plate 9, so that the metal part of the switch 81 cannot be observed from the pins surface, improving the safety of use and meeting the requirement of UL safety certification. The present invention may realize the functions of 2700K, 3500K, 4000K, 4500K, 5000K and 6500K etc. of various conventional color temperatures. Moreover, the luminous flux power and luminous efficiency between different color temperatures are similar, which is more conducive to controlling the deviation. Further, at high and low color temperatures, two sets of LEDs are lit at the same time. The current of a single LED is lower.

The whole light efficiency is higher. The LED temperature is evenly distributed. The LED life is greatly improved. The light efficiency at high and low color temperatures is greatly improved. The performance is reliable and the production cost is low. It also avoids the waste in the existing technology when a single set LEDs is on and the other set of LED is off when the color temperature is adjusted high and low, thus is more energy-saving and environmentally friendly.

Finally, it should be noted that the above are only the preferred embodiments of the present invention and are not intended to limit the present invention. Although the present invention has been described in detail with reference to the foregoing embodiments, those skilled in the art can still modify the technical solutions described in the foregoing embodiments, or perform equivalent replacements for some of the technical features. Any modification, equivalent replacement, improvement, etc. made within the spirit and principle of the present invention shall be included in the protection scope of the present invention.

The invention claimed is:

1. An LED straight tube lamp with an end face switch for a tone adjustment and a power adjustment, comprising a lamp tube, wherein an inside of the lamp tube is provided with a light source board, one end of the lamp tube is provided with a first plug, another end of the lamp tube is provided with a second plug, both the first plug and the second plug are provided with pins, the first plug is provided with a first driving board embedded in the lamp tube, the second plug is provided with a second driving board embedded in the lamp tube, both the first driving board and the second driving board are connected to the light source board, a switch is provided on the second driver board, an end face of the second plug is provided with an oblique groove, an interior of the oblique groove is provided with a notch for extending a handle of the switch, and an inside of the second plug is provided with a card slot, and both sides of the second driving board are embedded inside the card slot.

2. The LED straight tube lamp with an end face switch for a tone adjustment and a power adjustment of claim 1, wherein an end of the handle of the switch is flush with the end face of the second plug.

3. The LED straight tube lamp with an end face switch for a tone adjustment and a power adjustment of claim 1, wherein a positioning mark is provided on the oblique groove.

4. The LED straight tube lamp with an end face switch for a tone adjustment and a power adjustment of claim 1, further comprises a switch plate, and the switch plate is located between the switch and the oblique groove.

5. The LED straight tube lamp with an end face switch for a tone adjustment and a power adjustment of claim 4, wherein an inside of the switch plate is provided with a through groove.

6. The LED straight tube lamp with an end face switch for a tone adjustment and a power adjustment of claim 1, further comprises a label sleeve, the label sleeve is sleeved on an outside of the lamp tube at a position corresponding to the first driving board.

7. The LED straight tube lamp with an end face switch for a tone adjustment and a power adjustment of claim 1 wherein the second driver board is provided with a dimming circuit, the light source board is provided with two different color temperature LED lamp beads, one is LED1-LEDn, another is LED1'-LEDn', and wherein the dimming circuit comprises a driving power supply U1, a positive terminal of the driving power supply U1 is connected to positive terminals of the LED1-LEDn and the LED1'-LEDn' respectively; a negative terminal of LED1-LEDn is respectively connected to a positive terminal of a diode D1, one end of a resistor R1, a resistor R2, a resistor R3 and a resistor R4, another end of the resistor R1 and the resistor R2 are connected to a positive terminal of a diode D2, another end of the resistor R3 and the resistor R4 are connected to a positive terminal of a diode D3, a negative terminal of the LED1'-LEDn' is respectively connected to a positive terminal of a diode D5, one end of a resistor R5, a resistor R6, a resistor R7 and a resistor R8; another end of the resistor R5 and the resistor R6 are connected to a positive terminal of a diode D4, another end of the resistor R7 and the resistor R8 are connected to a positive terminal of a diode D6, negative terminals of the diode D2 and the diode D5 are connected to a pin 1 of a switch SW, negative terminals of the diode D3 and the diode D4 are connected to a pin 2 of the switch SW, negative terminals of the diode D1 and the diode D6 are connected to a pin 3 of the switch SW, and a pin 4 of the switch SW is connected to a negative terminal of the driving power supply U1.

* * * * *